US008075250B2

(12) United States Patent
Zhou et al.

(10) Patent No.: US 8,075,250 B2
(45) Date of Patent: Dec. 13, 2011

(54) FASTENING DEVICE FOR FANS

(75) Inventors: Zhi-Yong Zhou, Shenzhen (CN); Qiao-Li Ding, Shenzhen (CN); Hai-Bing Cao, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 619 days.

(21) Appl. No.: 12/241,066

(22) Filed: Sep. 30, 2008

(65) Prior Publication Data

US 2010/0014966 A1 Jan. 21, 2010

(30) Foreign Application Priority Data

Jul. 18, 2008 (CN) ..... 2008 1 0302792

(51) Int. Cl.
*F01D 1/24* (2006.01)

(52) U.S. Cl. ..... 415/68; 24/453; 411/510

(58) Field of Classification Search ..... 415/220, 415/68; 411/508–510; 24/453
See application file for complete search history.

(56) References Cited

U.S. PATENT DOCUMENTS

| | | | | |
|---|---|---|---|---|
| 4,495,380 | A * | 1/1985 | Ryan et al. | 174/138 D |
| D291,278 | S * | 8/1987 | Hill | D8/354 |
| 2008/0031722 | A1 * | 2/2008 | Yoshida | 415/68 |

FOREIGN PATENT DOCUMENTS

| | | |
|---|---|---|
| CN | 2934703 | 8/2007 |

* cited by examiner

*Primary Examiner* — Ross Gushi
(74) *Attorney, Agent, or Firm* — Altis Law Group, Inc.

(57) ABSTRACT

A fastening device is used for connecting a first and a second fan together. The two fans each have an upper flange and a lower flange and a cylindrical body interconnecting the upper flange and the lower flange. The fastening device includes a plate-shaped pad and two resilient portions respectively extending perpendicularly from two opposite sides of the pad. The two resilient portions respectively extend through the lower flange of the first fan and the upper flange of the second fan, pressing against the first fan and the second fan toward each other. The pad is sandwiched between the lower flange of the first fan and the upper flange of the second fan.

14 Claims, 3 Drawing Sheets

FASTENING DEVICE FOR FANS

BACKGROUND OF THE INVENTION

1. Field of the Invention

The present invention relates generally to a fastening device, and more particularly to a fastening device for connecting fans together.

2. Description of Related Art

With development in computer technology, electronic devices operate at high speed. It is well known that higher speed the electronic devices operate at, more heat they generate. If the heat is not dissipated duly, the stability of the operation of the electronic devices will be impacted severely. Generally, in order to ensure the electronic device to run normally, a fan is used to dissipate the heat generated by the electronic device. However, a single fan may not provide enough airflow; multiple fans are thus desired to connect with each other for generating a stronger airflow.

Typically, in order to connect two fans together, a plurality of screws are usually used to extend through a plurality of through holes in corners of the two fans and engage with a plurality of nuts. However, during assembly, a screwdriver is needed to manipulate the screws, resulting in the assembling process complicated and time-consuming. Moreover, since the two fans are connected together together by the screws which are rigid in nature, a sympathetic vibration is easily generated between the fans, which can produce an unbearable noise. In addition, a method for relieving the sympathetic vibration by adding an elastic gasket between the two fans is costly and cumbersome.

What is needed, therefore, is a fastening device for connecting fans which can overcome the above disadvantages.

SUMMARY OF THE INVENTION

A fastening device is used for connecting a first and a second fans together. The two fans each have an upper flange and a lower flange and a body interconnecting the upper flange and the lower flange. The fastening device includes a plate-shaped pad and two resilient portions respectively extending perpendicularly from two opposite sides of the pad, and two protrusions interconnecting the two resilient portions and the pad. The two resilient portions respectively extend through the lower flange of the first fan and the upper flange of the second fan, pressing the first fan and the second fan toward each other. The pad is sandwiched between the lower flange of the first fan and the upper flange of the second fan, supporting the first fan and the second fan thereon. The fastening device can efficiently relieve a sympathetic vibration of the first and second fans when the connected first and second fans are in operation, thereby to reduce a noise level generated by the operated first and second fans. Moreover, with the resilient structure of the resilient portions, the fastening device can secure the first and second fans conveniently, omitting the necessity of using any tool.

Other advantages and novel features will become more apparent from the following detailed description of preferred embodiments when taken in conjunction with the accompanying drawings.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
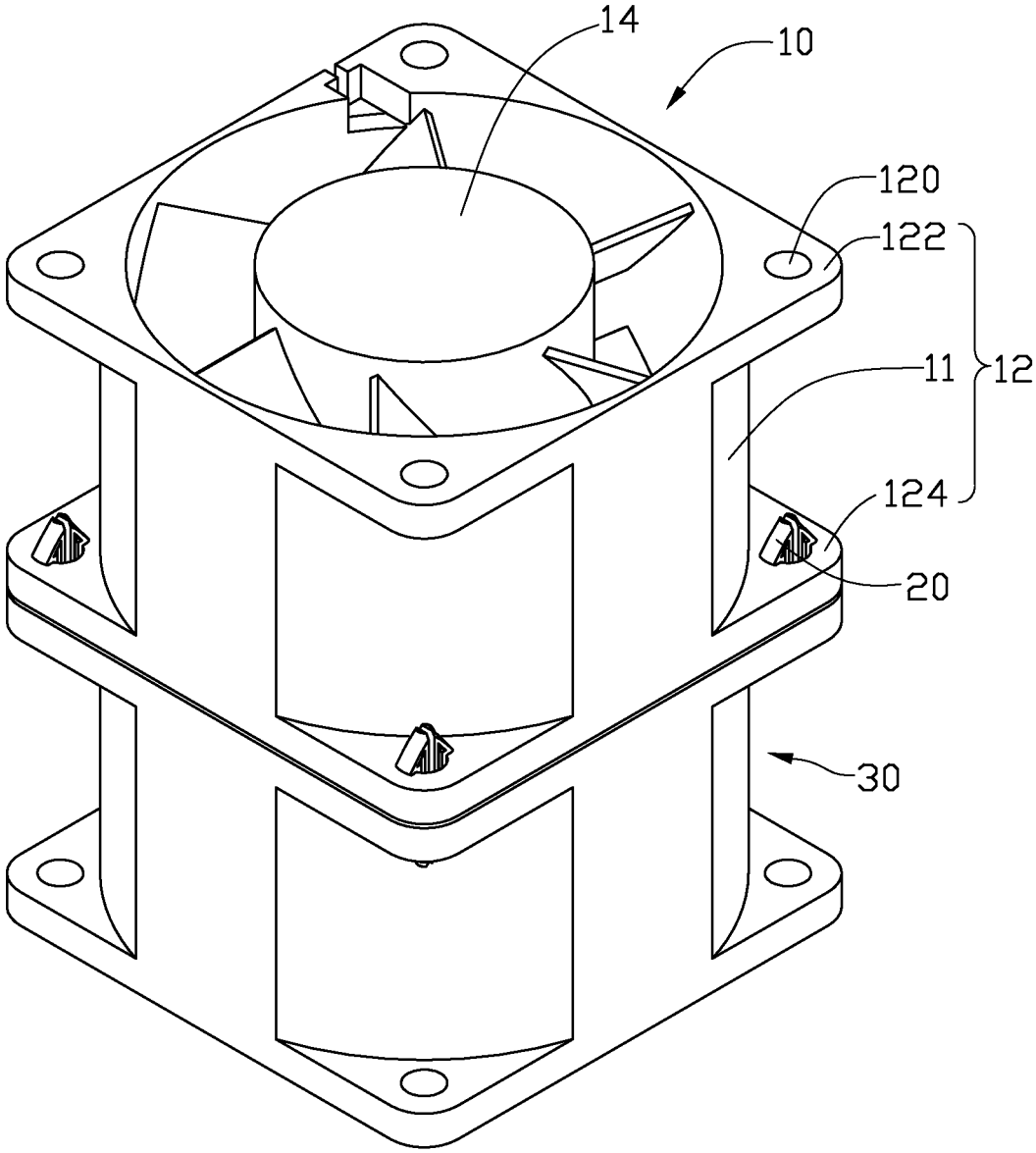
FIG. 1 is an assembled view of fastening devices in accordance with an embodiment of the present invention, interconnecting two fans together.
Figure 2:
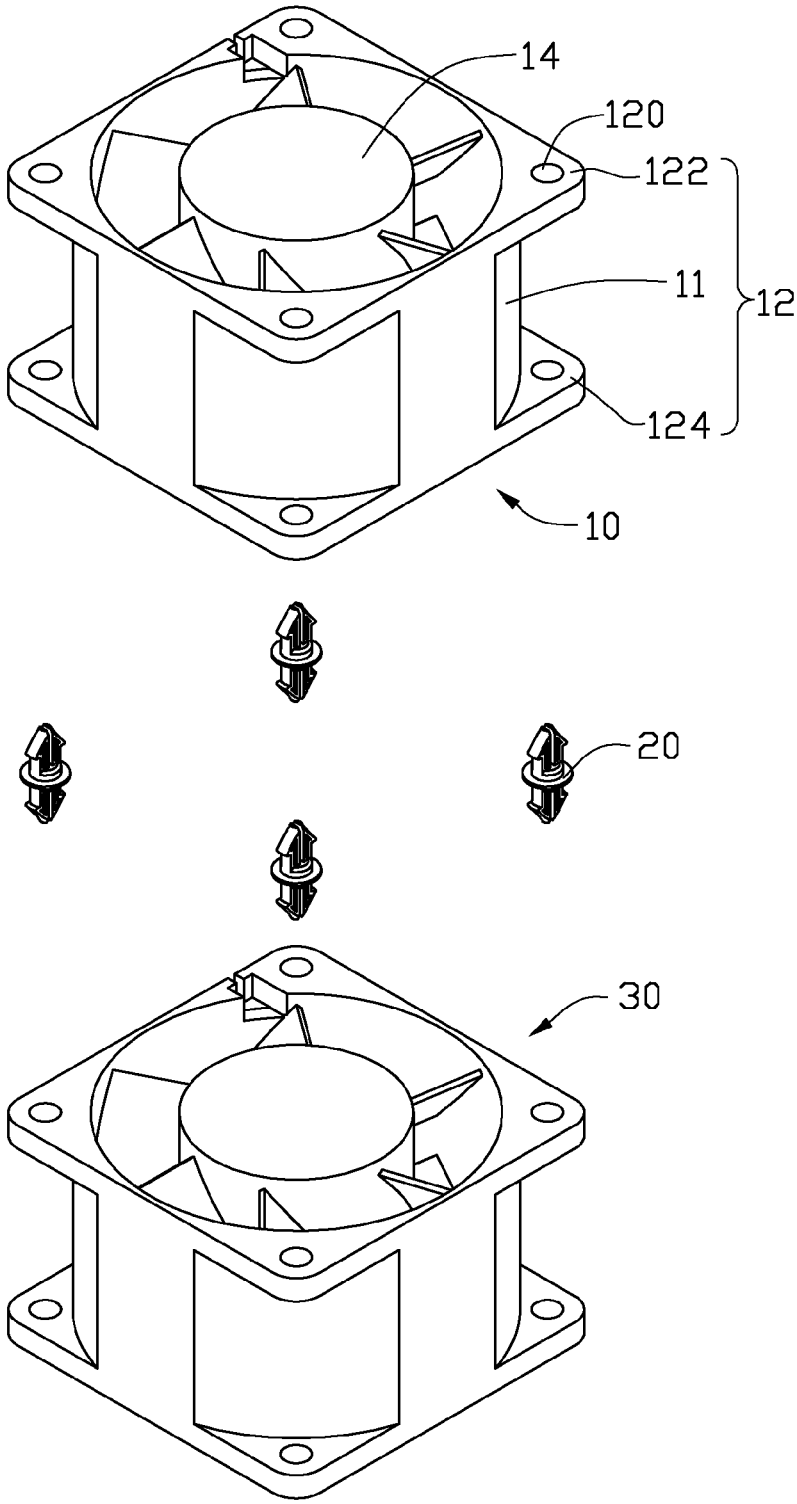
FIG. 2 is an exploded view of FIG. 1.

Referring to FIG. 1 and FIG. 2, four fastening devices 20 in accordance with an embodiment of the present invention are used for connecting a first fan 10 with a second fan 30 together. The first and second fans 10, 30 are axial fans and have the same size and shape. Each of the first and second fans 10, 30 includes a hollow frame 12 and an impeller 14 received in a center of the frame 12. The frame 12 has a substantially rectangular shape, and comprises a cylindrical body 11, an upper flange 122 and a lower flange 124 respectively extending outwardly and horizontally from a circumferential periphery of a top and a bottom of the cylindrical body 11. The upper and lower flanges 122, 124 each define four through holes 120 in four corners thereof.

Figure 3:
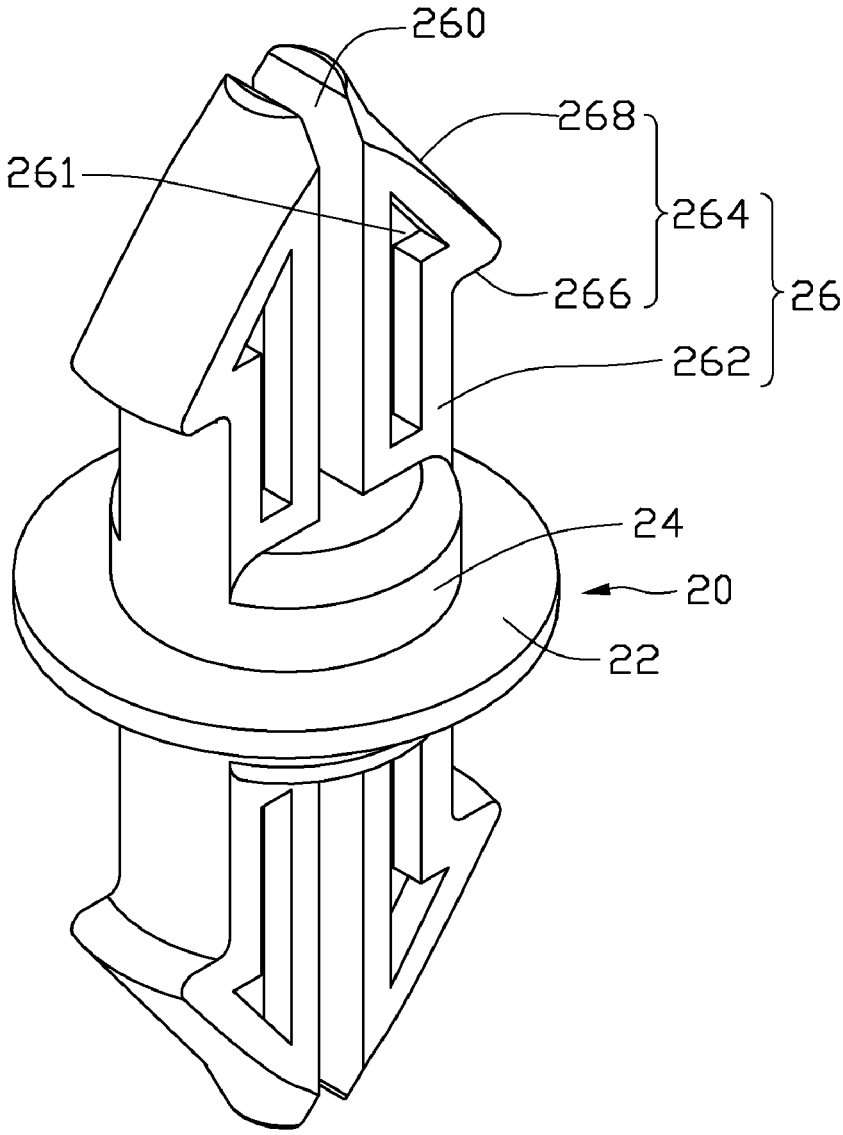
FIG. 3 is an enlarged view of a single fastening device of FIG. 2.

Also referring to FIG. 3, each of the four fastening devices 20 is integrally formed of an elastic material such as plastic or rubber. The fastening device 20 includes a circular, plate-shaped pad 22, two cylindrical protrusions 24 respectively extending perpendicularly and oppositely from central portions of top and bottom surfaces of the pad 22, and two resilient portions 26 respectively extending perpendicularly and oppositely from the two protrusions 24. The two protrusions 24 are symmetrical and the two resilient portions 26 are symmetrical, with respect to the pad 22.

The pad 22 has a diameter larger than that of each through hole 120 of the first and second fans 10, 30. The pad 22 is placed between a bottom face of the lower flange 124 of the first fan 10 and a top face of the upper flange 122 of the second fan 30, whereby the first and second fans 10, 30 are separated from each other and resiliently supported by the pads 22. A sympathetic vibration generated between the first and second fans 10, 30, when the first and second fans 10, 30 are in operation, is prevented by the present invention. The two protrusions 24 each have a cylindrical configuration and have a diameter equal to that of the each through hole 120 of the first and second fans 10, 30, so that the two protrusions 24 can be fittingly inserted into corresponding through holes 120, preventing the first and second fans 10, 30 from vibration relative to the fastening device 20. The two resilient portions 26 are used for cooperating with the pads 22 to firmly sandwich the lower flange 124 of the first fan 10 and the upper flange 122 of the second fan 30 therebetween.

Each resilient portion 26 comprises two spaced flexible arms 262 connecting the protrusion 24 and two retaining portions 264 respectively formed at distal ends of the two flexible arms 262. A longitudinal gap 260 is defined between the two flexible arms 262 for providing a deforming space to the two flexible arms 262. The two flexible arms 262 of each resilient portion 26 can be deformed toward each other in the gap 260 when being inserted into a corresponding through hole 120 of the first and second fans 10, 30. The retaining portion 264 has a right-angled triangular configuration in this embodiment. The retaining portion 264 includes a flat abutting face 266 and a slantwise guiding face 268 slanting inwardly towards a distal end thereof. The slantwise guiding face 268 can be pressed by an interior surface of the corresponding through hole 120 of the first and second fans 10, 30, to push a corresponding flexible arm 262 inwardly and thus guide the corresponding flexible arm 262 through the corresponding through hole 120 of the first and second fans 10, 30. The flat abutting face 266 is used for pressing a top surface of the lower flange 124 of the first fan 10 or a bottom surface of the upper flange 122 of the second fan 30 after the retaining portion 264 extends beyond the corresponding through hole 120 of the first or second fan 10, 30, thereby fixing the first and second fans 10, 30 together. A distance between the abutting face 266 and an adjacent face of the pad 22 is equal to a thickness of the upper or lower flange 122, 124 so that the upper or lower flange 122, 124 can be firmly and intimately sandwiched between the retaining portion 264 and the pad 22 of the fastening device 20. An opening 261 is conformably defined in each of the two flexible arms 262 and a corresponding retaining portion 264, to thereby increase a resilience of the resilient portion 26.

In assembly, a top end of each fastening device 20 is brought to extend through the corresponding through hole 120 of the lower flange 124 of the first fan 10. Due to confine of the through hole 120 of the lower flange 124, the flexible arms 262 are deformed inwardly to make the retaining portion 264 passing through the through hole 120 of the lower flange 124 of the first fan 10. After the fastening device 20 being substantially inserted into the through hole 120 of the lower flange 124 of the first fan 10, the flexible arms 262 are released outwardly to their original positions. At this position, the lower flange 124 of the first fan 10 is sandwiched and fixed between the retaining portions 266 and the pad 22, with the abutting faces 266 of the retaining portions 264 abutting against the top surface of the lower flange 124 of the first fan 10 downwardly and the pad 22 pressing the bottom surface of the lower flange 124 of the first fan 10 upwardly. A bottom end of each fastening device 20 can be fixed in the second fan 30 according to above protrusions, with a manipulating orientation thereof being inverted. Thus, the first and second fans 10, 30 are firmly connected together.

The fastening device 20 can efficiently relieve a sympathetic vibration of the first and second fans 10, 30, thereby to reduce the noise level during operation of the first and second fans 10, 30. Moreover, with the resilient structure of the resilient portions 26, the fastening device 20 can secure the first and second fans 10, 30 conveniently, without the requirement of using a tool It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A fastening device used for fixing a first fan and a second fan together, each of the first fan and the second fan comprising a first flange and a second flange and a body interconnecting the first flange and the second flange, the fastening device comprising:

a pad; and two resilient portions respectively extending perpendicularly from two opposite sides of the pad, the two resilient portions for respectively extending through the first flange of the first fan and the second flange of the second fan neighboring to the first flange of the first fan, and the pad being for sandwiched between the first flange of the first fan and the second flange of the second fan, and ends of the two resilient portions opposite to the pad for abutting against the first flange of the first fan and the second flange of the second fan toward the pad, respectively when the fastening device fixing the first fan and the second fan together;

wherein each of the two resilient portions comprises two spaced flexible arms and two retaining portions respectively formed at distal ends of the two flexible arms, a longitudinal gap being defined between the two flexible arms; and wherein an opening is conformably defined in each of the two flexible arms and a corresponding one of the two retaining portions.

2. The fastening device as claimed in claim 1, wherein the fastening device is integrally formed of plastic or rubber.

3. The fastening device as claimed in claim 1, wherein the pad is circular and plate-shaped.

4. The fastening device as claimed in claim 1, wherein each of the two retaining portions has a triangular configuration, the two retaining portions being for abutting against a corresponding one of the first flange of the first fan and the second flange of the second fan.

5. The fastening device as claimed in claim 4, wherein the each of the two retaining portions has a right-angled triangular configuration.

6. The fastening device as claimed in claim 5, wherein the each of the two retaining portions includes a flat abutting face for pressing the corresponding one of the first flange of the first fan and the second flange of the second fan, and a slantwise guiding face slanting inwardly from the flat abutting face towards a distal end thereof.

7. The fastening device as claimed in claim 1, further including two protrusions respectively extending from the two opposite sides of the pad, each of the two protrusions interconnecting the pad and the two flexible arms of a corresponding one of the two resilient portions, and for being inserted into a corresponding one of the first flange of the first fan and the second flange of the second fan.

8. A fan assembly, comprising:

a first fan and a second fan each including a hollow frame and an impeller received in a center of the frame, the frame having an upper flange and a lower flange and a body interconnecting the upper flange and the lower flange; and a plurality of fastening devices connecting the first fan and second fan together, each of the plurality of fastening devices comprising:

a pad being sandwiched between the lower flange of the first fan and the upper flange of the second fan; and two resilient portions respectively extending perpendicularly from two opposite sides of the pad, wherein the two resilient portions are deformable to extend through the lower flange of the first fan and the upper flange of the second fan, pressing the lower flange of the first fan and the upper flange of the second fan toward each other;

wherein each of the two resilient portions comprises two spaced flexible arms and two retaining portions respectively formed at distal ends of the two flexible arms, the two retaining portions abutting against a corresponding one of the lower flange of the first fan and the upper flange of the second fan;

wherein the fastening device further includes two protrusions respectively extending from the two opposite sides of the pad and connecting the two spaced flexible arms, the two protrusions being inserted into the lower flange of the first fan and the upper flange of the second fan, respectively.

9. The fan assembly as claimed in claim 8, wherein each of the two retaining portions includes a flat abutting face pressing the corresponding one of the lower flange of the first fan and the upper flange of the second fan, and a slantwise guiding face slanting inwardly from the flat abutting face towards a distal end thereof.

10. The fan assembly as claimed in claim 9, wherein a distance between the abutting face and the adjacent surface of the pad is equal to a thickness of each of the upper flange and the lower flange of the first fan and the second fan.

11. The fan assembly as claimed in claim 8, wherein the two protrusions are symmetrical, and the two resilient portions are symmetrical, with respect to the pad.

12. The fan assembly as claimed in claim 8, wherein an opening is conformably defined in each of the two flexible arms and a corresponding one of the two retaining portions.

13. The fan assembly as claimed in claim 8, wherein each of the two resilient portions has a configuration similar to that of an arrowhead.

14. A fan assembly, comprising:

a first fan and a second fan each including a hollow frame and an impeller received in a center of the frame, the frame having an upper flange and a lower flange and a body interconnecting the upper flange and the lower flange; and a plurality of fastening devices connecting the first fan and second fan together, each of the plurality of fastening devices comprising:

a pad being sandwiched between the lower flange of the first fan and the upper flange of the second fan; and two resilient portions respectively extending perpendicularly from two opposite sides of the pad, wherein the two resilient portions are deformable to extend through the lower flange of the first fan and the upper flange of the second fan, pressing the lower flange of the first fan and the upper flange of the second fan toward each other;

wherein each of the two resilient portions comprises two spaced flexible arms and two retaining portions respectively formed at distal ends of the two flexible arms, the two retaining portions abutting against a corresponding one of the lower flange of the first fan and the upper flange of the second fan;

wherein an opening is conformably defined in each of the two flexible arms and a corresponding one of the two retaining portions.

* * * * *